United States Patent [19]

Poole

[11] Patent Number: 4,533,416

[45] Date of Patent: Aug. 6, 1985

[54] PELLETIZABLE PROPELLANT

[75] Inventor: Donald R. Poole, Woodinville, Wash.

[73] Assignee: Rockcor, Inc., Redmond, Wash.

[21] Appl. No.: 291,148

[22] Filed: Aug. 7, 1981

Related U.S. Application Data

[63] Continuation of Ser. No. 91,965, Nov. 7, 1979, abandoned.

[51] Int. Cl.[3] ..... C06B 35/00

[52] U.S. Cl. ..... 149/35; 149/37; 149/109.6

[58] Field of Search ..... 149/35, 37, 109.6

[56] References Cited

U.S. PATENT DOCUMENTS

| | | | |
|---|---|---|---|
| 3,741,585 | 6/1973 | Hendrickson et al. | 149/35 |
| 3,779,823 | 12/1973 | Price et al. | 149/35 |
| 3,785,674 | 1/1974 | Poole et al. | 149/35 |
| 3,797,854 | 3/1974 | Poole et al. | 149/35 |
| 3,814,694 | 6/1974 | Klager | 252/186 |
| 3,883,373 | 5/1975 | Sidebottom | 149/35 |
| 3,895,098 | 7/1975 | Pietz | 149/35 |
| 3,904,221 | 9/1975 | Shiki et al. | 23/281 |
| 3,947,300 | 3/1976 | Passover et al. | 149/35 |
| 4,021,275 | 5/1977 | Kishi et al. | 149/35 |
| 4,203,787 | 5/1980 | Kirchott et al. | 149/35 |

FOREIGN PATENT DOCUMENTS

| | | |
|---|---|---|
| 1447460 | 8/1976 | United Kingdom . |

*Primary Examiner*—Edward A. Miller

*Attorney, Agent, or Firm*—Dowrey & Cross

[57] ABSTRACT

A pelletized propellant particularly suitable for crash restraint device inflation apparatus comprising an alkali metal azide, an oxidizing agent, and a metal oxide formed by dehydrating a hydrated oxide formed in situ, the burn time and sensitivity of the composition being adjusted to produce the necessary properties for crash restraint device inflators.

18 Claims, No Drawings

PELLETIZABLE PROPELLANT

This application is a continuation of Ser. No. 091,965 filed Nov. 7, 1979 now abandoned.

FIELD OF THE INVENTION

The propellant of this invention was developed for use in crash restraint device inflators. As a propellant it is adapted for a controlled burn time and lack of sensitivity to environmental conditions. Being suitable as a crash restraint inflation propellant, the propellant of this invention is suitable for other, similar as well as less severe uses.

BACKGROUND OF THE INVENTION

To be suitable for inflating crash restraint systems, a propellant composition must meet a unique and exceptionally demanding set of physical and chemical criteria. It must be resistant to aging, automobile environments, and be adaptable to assembly line handling. The propellant must produce non-toxic decomposition products upon ignition and burn at a sufficiently low temperature to prevent harm to the driver. The composition must provide a wide margin of safety during assembly, use and disassembly of the automobile. The propellant must burn at a rapid and highly reproducable rate to act as a satisfactory inflation means. The properties required of an inflation propellant are discussed in greater detail below.

The first parameter considered in the selection of an inflator propellant is that of which gas to produce. The gas must be non-toxic and should not react with environmental substances in manners leading to the production of toxic or dangerous materials. Gases suitable for use include nitrogen, carbon dioxide, and the noble or inert gases. No satisfactory means for generating noble gases exists at the present time. Carbon dioxide is usually generated by burning carbon containing compounds in the presence of an oxidizing agent. Present art devices for generating carbon dioxide sufficiently rapidly for use as inflator propellants however produce gas temperatures considered excessive for use in air bags. The use of organic compounds can also lead to production of carbon monoxide, carbon dioxide or other toxic by-products. Practical inflator propellants therefore rely on nitrogen as the reaction product. Nitrogen is commonly produced by decomposition of an azide.

The second parameter considered is the burn rate of the propellant. A crash restraint device must inflate within 0.1 second of an impact to be effective. Obviously the propellant must completely burn in less than this amount of time. The propellant must not however burn so rapidly as to create a danger of explosion. Burn rate is determined by chemical composition and physical configuration. An alkali metal azide decomposes too slowly at obtainable temperatures to be useful alone as a propellant. Oxidizers are added to the azide to increase burn rate. Oxidizers that have been used include metallic chlorates, perchlorates, oxides, and nitrates. Metallic chlorates find limited use as their sensitivity to shock and friction presents a possibility of preignition and possible malfunction. In general, perchlorates and oxides are the most satisfactory oxidants. Perchlorates as oxidants in combination with azides have the advantage of rapid burning and the disadvantage of a higher temperature of decomposition. Oxide oxidants, in general, burn more slowly and at lower temperatures.

The third parameter considered is the temperature of decomposition. If the propellant decomposes at too high a temperature the hot gas produced could constitute a danger to the user. This parameter must be balanced with the burn rate as rapid burning compositions most often have a high temperature of decomposition. One attempted solution to this problem has been to add a coolant. Organic compounds are commonly used for this purpose, but often result in the production of carbon monoxide upon reaction with an oxidant that may be present. Florocompounds have also been used with similar difficulties. The most satisfactory propellant considering the first three parameters would thus appear to be fast burning metallic oxide oxidizer and an azide.

A propellant composition which comes close to satisfying the first three parameters is sodium azide and iron oxide. One such composition uses 70% by weight sodium azide and 30% by weight iron oxide. The characteristics of this propellant are influenced to a large extent by the form of iron oxide used in formulation. While all iron oxide used is described by the chemical formula $Fe_2O_3$ there are marked variations in burn rate and handling properties dependent upon the particle size and crystalline form. This propellant is compounded by either dry mixing of commercial ferric oxide and sodium azide or wet mixing of commercial ferric oxide with sodium azide in the presence of water to partially dissolve the sodium azide and insure a more homogeneous mix. The water does not react chemically with either of the constituents. This composition exhibits a satisfactory burn temperature and does not produce toxic products but is plagued by insufficient physical strength and a slow burn rate. Research on improving this propellant has led to an improvement in a fourth relevant parameter.

The fourth parameter, strength, is related to the physical form of the propellant. As stated above in the discussion of burn rate the physical form of the propellant influences the burn time. Since inflator propellants burn very rapidly rather than detonate the burn time is directly dependent upon the surface area exposed at any given time during the propellants' decomposition. Propellant shapes that have been used include powders, granules and shaped pellets of various types. Powdered propellants burn rapidly but tend to separate upon vibration and storage into their constituent parts. Powders can also clog filtering means in the gas stream. Granules and pellets burn at slower rates and do not separate. Pellets have the most reproducable burning rates as their shape is fixed by their method of manufacture. A satisfactory propellant thus must be capable of pelletization. Once a propellant is pelletized it is essential that the pellets formed are not prone to breakage or cracking. If propellants of a given burn rate and given shape are broken in any significant numbers the surface area is increased. If the surface area of a pellet is increased the burn time decreases. Too rapid a burn time can lead to explosion or destruction of the inflator apparatus. Cracks in propellant pellets have a similar effect and are to be avoided. Prior art metal oxide-azide propellants have been prone to breakage and cracking as well as having insufficient burn rate.

To summarize, the parameters governing satisfactory propellants are: gas produced, burn rate, temperature of decomposition and strength. No one of the prior art propellants satisfy all of these parameters.

SUMMARY OF THE INVENTION

An azide-oxide propellant mixture is prepared in such a manner that a gelatinous hydrated oxide of a transition metal is generated in situ during the compounding. The mixture is dried thus dehydrating the oxide. The oxide formed by this process strengthens any pellents formed from the composition. A by-product of the reaction which produces the oxide is an alkali metal nitrate, which acts as an additional oxidizing agent resulting in an improved burn rate.

A first embodiment of the invention is comprised of a mixture of a metallic oxide and a metal azide. Iron oxide has been found to be a superior oxide for use in propellant pellets due to its klinker forming capabilities. Sodium azide is used as a metal azide. A metal salt is mixed thoroughly with the oxidant. This is accomplished by dissolving the salt in water and stirring the resulting solution and the oxidant together. A base such as a solution of an alkali metal hydroxide in water is added slowly to the mixture while stirring until the mixture is neutral or basic. The resulting mixture is a thick paste. This paste is dried in an oven to remove water. The dry cake is then broken up, screened and blended with the proper amount of azide. The blending can be accomplished either by stirring the powders together by hand or in a conventional twin shell blender. The resulting powder then may be pelletized in ordinary pelletizing equipment such as a Stokes pellet press.

In a second embodiment of the invention the azide is added before the paste is dried and the resulting paste with azide is dried. The dried paste is screened and pelletized.

In a third embodiment pellets are made by adding a molten salt such as ferric nitrate $(Fe(NO_3)_3).9H_2O$ to ferric oxide and allowing the mixture to cool. A base is added until the mixture tests basic. An azide is blended with a broken cake resulting from drying of the above reaction product.

In all embodiments a hydrated oxide is precipitated and dried with the particles of the oxidant. The exact formula of this hydrated oxide is unknown. The hydrated oxide is a gelatinous greasy material until dried. After drying it is chemically indistinguishable from other oxides. The oxide formed, however, is of a different microscopic structure that attaches to and modifies the existing oxide particles making them more easily cemented together by sodium azide. The reaction that precipitates the oxide also produces an alkali metal nitrate which acts to accelerate the burning rate of the pellet. While the oxide particle size is increased by this process the burning rate is not decreased. This is an unexpected result. The amount of alkali nitrate formed in the mixture is such that there is no significant production of oxides of nitrogen. The resulting pellets maintain dimensional integrity without any diminishment of burning rate.

DETAILED DESCRIPTION OF THE INVENTION

The substance which provides the strength in the propellant compositions of the present invention is the product formed upon the drying of a hydrated metallic oxide. Metallic oxide is intended to include the oxides of iron, aluminum, magnesium, cobalt, nickel, copper, manganese, and chromium as well as transition metals which form hydrated oxides upon precipitation of a soluble salt of the metal with a base. Bases include the hydroxides of sodium, potassium, lithium, rubidium, and cesium as well as functional equivalents thereof such as alkaline earth metal hydroxides. Bases also include basic salts such as sodium silicate. Soluble metallic salts of the transition metals include the nitrates, chlorates, perchlorates, chlorides, and functional equivalents thereof. The transition metal salts include ferric perchlorate, ferric chloride, and ferric nitrate but are not limited thereto. Propellants used for air bag inflators in the broadest sense are comprised of an oxidizing agent combined with an azide. Sodium azide ($NaN_3$) is generally the azide selected but other functional equivalents may be used such as potassium ($KN_3$) or lithium azide ($LiN_3$). Oxidizers used in formulation of crash restraint propellants include potassium perchlorate ($KCLO_4$), manganese dioxide ($MnO_2$), copper oxide ($CuO$), potassium nitrate ($KNO_3$), and ferric oxide ($Fe_2O_3$). The propellants of the present invention are of the type that use from 50–80% by weight of an azide combined with from 50–20% by weight of a metallic oxide. Successful propellants can be compounded using from one to three parts oxidizer to each seven parts azide. The invention, of course, may be used with other equivalent propellants.

The propellants of the present invention may be formulated by using any of several combinations of the above ingredients. The properties of the propellant so formulated are dependent upon the form, crystalline structure, and degree of division of the ingredients as well as the chemical composition thereof. The order of formulation and the process used in formulation can determine the characteristics of the propellant to a significant degree. Particularly important is the microcrystalline form of the metallic oxide used as an oxidizer. The metallic oxides used must often thus be identified by source and type as well as chemical formula.

The first procedure used for formulating the propellant is as follows: A transitional metal salt is mixed thoroughly with the metallic oxide. The metallic oxide is preferably in powder form. The mixing is preferably accomplished by dissolving the transition metal salt in a solvent, preferably water, and stirring the resulting solution and the metal oxide together. The base, preferably in solution, is added slowly to the salt oxide mixture while stirring until the mixture is neutral or basic. The mixture that results from the above steps is dried in an oven to remove the solvent. The mixture from the above steps is usually a thick paste that is dried to form a dried cake. The dried cake is then broken up, screened and blended with a predetermined amount of azide. The blending may be accomplished by conventional blending means and has been performed by simply stirring the powders together. A preferable method of blending is utilization of a conventional twin shell blender. The blended propellant then may be pelletized in conventional pelletizing equipment. In one embodiment a Stokes pellet press was used to form pellets from the propellant. Pellets formulated in the above manner have been found to have excellent strength whereas propellants made by combining the azide by simple mixing with the oxide are very soft and break apart easily.

The amount of transition metal salt used may be varied over a wide range. In propellants using ferric nitrate $(Fe(NO_3)_3)$ as the transition metal salt and potassium hydroxide ($KOH$) as the base it is convenient to describe the amount of ferric nitrate $(Fe(NO_3)_3)$ by the concentration of potassium nitrate ($KNO_3$) in the finished propellant. From 1 to 15 percent potassium nitrate ($KNO_3$) in the finished propellant has been used when the amount of azide used was approximately 60 percent by weight. This results in a range of from about 2.4 to 38 percent potassium nitrate ($KNO_3$) in the oxidizer portion of the propellant. The lower figure has been used in formulation of propellants but amounts less than 2.4 percent may also be satisfactory. A similar definition of range is used with other alkali nitrates (such as $LiNO_3$), if compensation is made for the change in molecular weight. Thus, the final composition might include between 0.01 and 0.16 moles of lithium or potassium nitrate per mole of sodium azide. Both the lower and upper limits are dependent upon the characteristics desired in the finished propellant. A similar range is usable with other transition metal salts. Large amounts of nitrates are avoided for some fomulations and particularly in propellants which have relatively high temperatures of combustion. The high nitrate concentration is avoided due to the possibility of production of oxides of nitrogen such as $NO_2$ which limit the use in air bag inflators. In other less crucial applications the higher concentration of nitrate, of course, would be tolerable.

An alternative method of formulating the propellant is as follows: A transition metal salt is thoroughly mixed with the metal oxide oxidizer by dissolving the salt in a solvent and stirring the resultant solution and oxidizer together. A base is added slowly to the mixture while stirring until the mixture is neutral or basic. The base is frequently furnished as a solution in water. The azide is added to the resulting wet paste. The wet paste with added azide is then dried, screened and pelletized. Pellets made using this second formulation have excellent strength and a high burning rate. Additional precautions in the drying step must be undertaken when the propellant contains the added azide.

Numerous variations of the two above formulations are possible without departing from the basic invention. For example, a solution of sodium silicate which exhibits well known basic properties may be used alone or in combination with another base in the neutralization step. The use of sodium silicate results in extremely strong pellets and it is believed that the silicate or hydrated silica formed during neutralization contributes to the strength of the pellets. Another possible variation lies in the selection of metallic salts. When iron is used as the transition metal it may be added in the form of ferric nitrate ($Fe(NO_3)_3$) or ferric perchlorate ($Fe(ClO_4)_3$) or ferric chloride ($FeCl_3$). Other soluble iron salts could be used. The use of the nitrate or perchlorate result in the formation of potassium nitrate ($KNO_3$) or potassium perchlorate ($KCLO_4$) as by-products of the precipitation, both of which are excellent oxidizing agents which will increase the burning rate and combustion temperature. Use of the chloride results in potassium chloride (KCL) formation which is essentially inert in propellant burning. Propellants can also be formulated using copper, chromium, manganese, aluminum, magnesium, cobalt, nickel, and cerium as the transition metal. The selection of which salt of the transition metal to use is determined by the desired properties of the propellant. In general any transition metal salt that forms a gelatinous hydrated oxide upon reacting with a base is usable.

The precise theoretical mechanism for the resulting improvement in pellet strength is not known with certainty at this time. It is however, believed that the hydrated transition metal oxide, precipitated upon addition of the base, agglomerates the very fine particles of metal oxide and forms larger particles. The larger particles formed would be more easily cemented together by the azide. It is known that axides of the type used in propellant formulations flow under the pressures used in pelletization and could cement the larger particles of oxide together. The unexpected strength exhibited occurs without a major decrease in propellant burning rate which would be expected if a commercial metallic oxide of larger particle size were used in formulation of a propellant. The chemical reaction that occurs on formulation of the metallic oxide of a trivalent metal is as follows:

$$2M^{+++} + 60H^{-} + (n-3)H_2) \rightarrow M_2)_3.(H_2O)_n$$

$$M_2O_3.(H_2O)_n + \text{heat} \rightarrow M_2O_3 + n(H_2O)$$

$M_2O_3.(H_2O)_n$ is a hydrated transition metal oxide for which the exact formula is unknown. This material is a gelatinous greasy material until dried. Upon drying it becomes a metal oxide which is chemically indistinguishable from the metal oxide used in formulation of pellets. As described above, the behavior upon burning is essentially the same as that of the metal oxides normally used in formulation of propellants.

Burn rates may be tested by several conventional methods. A new method for testing burn rate was devised to simulate conditions of use and produce a meaningful test for inflator propellants. Cylindrical grains of propellant were prepared having a diameter of one half inch and a length of one half inch. The grains were coated partially with a material that prevents combustion on the coated surfaces. The entire grain was coated with this material with the exception of one circular face. This circular face of the cylinder was coated with an ignition mixture and an electric match was positioned near the ignition mixture. A thermocouple was buried in the coating at the other end of the grain. The propellant was placed in a tank which maintains a pressure of approximately 1,000 psi. The tank was of sufficient size so that pressure was not markedly increased upon pellet burning. An electrical current was then connected to the electric match igniting the propellant. The time was measured between the application of this current and the receipt of a signal from the thermocouple at the opposite end of the pellet. This method provided an accurate measure of the burn rate of pellet.

The following examples illustrate various aspects of the invention and are intended to be exempletory but not limiting of the scope of the invention. Unless otherwise indicated the ferric oxide ($Fe_2O_3$) used in the examples is Baker Analytical Reagent grade. All ingredients are specified as a percent by weight of the total composition unless otherwise indicated.

EXAMPLE 1

The following ingredients were blended together as dry powders: sodium azide 69.44%, ferric oxide 18.28%, potassium perchlorate 6.62%, boric acid 5.66%. The resulting mixture was then pressed in a laboratory Carver press. The resulting pellets were soft and had insufficient strength for use in inflators. Boric acid does not appear to be a satisfactory binding agent.

EXAMPLE 2

The ingredients were prepared and tested as in Example 1: sodium azide 73.59%, ferric oxide 9.70%, cupric oxide 9.69%, potassium perchlorate 7.02%. The pellets were of insufficient strength, showing that copper oxide did not add significantly to the strength of the pellets.

EXAMPLE 3

Pellets were prepared as in Example 1 using sodium azide 72.88%, ferric oxide 19.18%, potassium perchlorate 6.95%, calcium stearate 0.99%. Calcium stearate had shown some promise as a binding agent but the pellets of this example showed no significant increase in strength over pellets made without stearate.

EXAMPLE 4

Pellets were prepared as in Example 1 from 72.16% sodium azide, 19.00% ferric oxide, 6.84% potassium perchlorate and 2.00% calcium stearate. Increasing the percentage of calcium stearate did not add significantly to the strength of this composition.

EXAMPLE 5

Pellets were prepared as in Example 1: 72.16% sodium azide, 19.00% ferric oxide, 6.84% potassium perchlorate, 2.00% graphite. Graphite was used in some compositions as a die lubricant. This composition was tested to determine if graphite aided in binding the pellets. The result was that graphite did not significantly aid in strengthening pellets.

EXAMPLE 6

Pellets were prepared as in Example 1: 72.16% sodium azide, 19.00% ferric oxide, 6.84% potassium perchlorate, 2.00% bentonite (clay). Some compositions have used bentonite (clay) as a binding agent. This test demonstrated that for this composition the bentonite did not aid significantly in the binding ability. A properietary clay (Nucap 100) was also used in the same proportions as bentonite and the results were similar.

EXAMPLE 7

Pellets were prepared as in Example 1: 74.36% sodium azide, 19.56% ferric oxide, 6.06% potassium perchlorate. This composition with no binding agent was tested and found to have insufficient strength for the intended use.

EXAMPLE 8

Ferric nitrate was heated in a water bath until molten. The ferric nitrate has a large percentage of water of hydration and melts at a moderate temperature. Ferric oxide was then combined with the molten ferric nitrate with agitation. A 50% by weight solution of potassium hydroxide and water was added to the above mixture and the pH monitored. When the mixture became basic the addition of potassium hydroxide was halted. The resulting mixture was spread out into a pan and dried in a laboratory oven at 110 C.°. The resulting dried product was seived through both 32 and 60 mesh screens. 168.3 grams of product was recovered and was then thoroughly blended with 300.0 grams of sodium azide. The sodium azide had been ground in a Bantam micropulverizer. The resulting mixture was pressed in a die on a laboratory Carver press to produce pellets of increased strength. This example demonstrates an alternative method of producing the improved propellant without the use of solutions.

EXAMPLE 9

1.32 grams of ferric nitrate was dissolved in 18.8 grams of water and 39.6 grams of ferric oxide added to the solution. A 50% solution of potassium hydroxide in water was then added slowly while monitoring pH until the mixture tested basic. The mixture was dried at 110 C.° and seived through 32 and 60 mesh screens. The dried mixture was blended with sodium azide prepared as in Example 8 in amounts such that the final mixture contained 59.3% sodium azide and 40.7% oxidizer. Pellets made by this process produced pellets of sufficient strength for use in air bag inflation apparatus.

EXAMPLE 10

The properties of commercial iron oxide vary widely. The iron oxide used in Examples 1 through 9 was Baker Analytical Reagent. This iron oxide was found to have similar properties to that of Mapico Red 297 produced by Cities Service Company. Tests were conducted with Mapico Reds 297, 516, 477, 567 produced by Cities Service Company as well as Pfizer R1599, R9998 and R04097 produced by Pfizer, Inc. using the process described in Example 9. The various iron oxides all produced pellets having satisfactory mechanical characteristics. The burn rate of the pellets varied and was dependent on the type of iron oxide used.

EXAMPLE 11

The process of Example 9 was followed with the substitution of 1.1 grams of ferric perchlorate for all of the ferric nitrate. The result was pellets having satisfactory mechanical characteristics and an increased burn rate.

EXAMPLE 12

1.32 grams of ferric nitrate was dissolved in 23.8 grams of water. 93.6 grams of Baker Analytical Reagent ferric oxide was stirred into the resulting solution. A 40% sodium silicate solution in water obtained from Van Waters and Rogers was added slowly with stirring and monitoring of pH until the mixture tested basic. The resultant paste was dried overnight at 110° C. and seived through 32 and 60 mesh screens. The resultant powder was blended with sodium azide and pressed as in Example 8. The pellets produced contained 59.2% sodium azide. This example produced the hardest pellets that were found to be satisfactory for use in inflators.

EXAMPLE 13

6.6 grams of ferric nitrate was dissolved in 200 grams of water and 198 grams of ferric oxide (Mapico 516 medium) was stirred into the solution. A mixture of 20 grams of 40% sodium silicate solution obtained from Van Waters and Rogers and 80 grams of 50% potassium hydroxide solution was added to the mixture while the pH was monitored until the mixture tested basic. The pellets were prepared as in Example 12. The resultant pellets were of satisfactory mechanical strength.

EXAMPLE 14

149.57 grams of ferric nitrate was dissolved in 7,079 grams of water and 4,490.6 grams of ferric oxide (Mapico Red 516 medium) was stirred in. A solution of 206 grams of potassium hydroxide and 44 grams of solid sodium silicate dissolved in 250 grams of water was added as in Example 12 and pellets produced as in Example 12. The resultant pellets were of excellent quality. This example demonstrates that the process may be scaled up.

EXAMPLE 15

3.94 grams of ferric nitrate were dissolved in 110 grams of water and 117.42 grams of ferric oxide added. A 50% solution of potassium hydroxide was added until the mixture tested basic. The resulting mixture was dried at 110 C.° and seived as in Example 8. The resultant powder was blended with sodium azide and graphite so that the final mixture contained 59.11% sodium azide, 40.39% oxidizer mixture, and 0.5% graphite. The following types of iron oxide were used in the above mixture: Mapico Red 300, Mapico Red 516 medium, Mapico Crimson 108, Mapico CG8, Mapico CG10, Northern Pigment 408, Northern Pigment 522. All of the above combinations produced pellets having satisfactory mechanical strength. The Mapico Crimson 108 ferric oxide produced pellets having especially satisfactory burn rates and was found to be superior to all other iron oxides tested.

EXAMPLE 16

The process described in Example 14 was followed with Mapico Crimson 108 ferric oxide and the amount of ferric nitrate dissolved in 63 grams of water was varied. The burn rate of the pellet was tested in the manner described above with the following results:

| GRAMS OF FERRIC OXIDE | GRAMS OF FERRIC NITRATE | BURN RATE |
|---|---|---|
| 120.79 | 0.40 | 0.473 |
| 120.41 | 0.80 | .468 |
| 119.28 | 2.00 | .481 |
| 117.44 | 3.94 | .523 |
| 113.59 | 7.99 | .554 |
| 102.22 | 19.98 | .552 |

All of the above combinations produced pellets having satisfactory mechanical strength. As is apparent, the burn rate increases as the percentage of ferric nitrate used in compounding the mixture increases. It is believed that the increase in burn rate results from the generation of potassium nitrate in the precipitation process.

While the invention has been described in terms of a few specific embodiments thereof, it will be appreciated that other forms could be adapted by one skilled in the art and, accordingly the invention is to be considered limited only by the scope of the following claims.

What is claimed is:

1. A gas generating composition formable into pellets of enhanced strength made by the process comprising the steps of:

forming a hydrated metal oxide gel by reacting a base with a metal salt, said metal being selected from the group consisting of aluminum, magnesium, chromium, manganese, iron, cobalt, copper, nickel, cerium and of the remaining transition series elements which form a gelatinous hydrated metal oxide when the salts thereof are reacted with a base;

mixing said hydrated metal oxide gel with a metal oxide oxidant chosen from the group consisting of the oxides of aluminum, magnesium, chromium, manganese, iron, cobalt, copper, nickel, cerium and of the remaining transition series elements which form a gelatinous hydrated metal oxide when the salts thereof are reacted with a base;

dehydrating the hydrated metal oxide in the presence said metal oxides oxidant; and adding a metal azide chosen from the alkali and alkaline earth azides.

2. The gas generating composition of claim 1 wherein said metal salt is chosen from the group consisting of the nitrates, chlorides, chlorates and perchlorates of said metals.

3. The gas generating composition of claim 1 wherein said metal oxide oxidant is mixed with said metal salt prior to reaction with said base.

4. The gas generating composition of claim 2 wherein the metal oxide oxidant is ferric oxide and the metal salt is ferric nitrate.

5. The gas generating composition of claim 4 wherein the resultant composition includes between 0.01 and 0.16 moles of nitrate per mole of azide.

6. The gas generating composition of claim 1 wherein the metal salt is a nitrate and wherein the resultant composition includes between 0.01 and 0.16 moles of nitrate per mole of azide.

7. The gas generating composition of claim 4 wherein substantially all of the anion of the metal salt is retained in the composition in the form of a salt during dehydration of the hydrated metal oxide gel.

8. The gas generating composition of claim 1 wherein said base comprises an alkali metal silicate.

9. The gas generating composition of claim 6 wherein substantially all of the anion of the metal salt is retained in said mixture during said dehydration.

10. A method of making a gas generating composition formable into pellets of enhanced strength comprising the steps of:

forming a hydrated metal oxide gel by reacting a base with a metal salt, said metal being selected from the group consisting of aluminum, magnesium, chromium, manganese, iron, cobalt, copper, nickel, cerium and of the remaining transition series elements which form a gelatinous hydrated metal oxide when the salts thereof are reacted with a base;

mixing said gel with a particulate metal oxide oxidant chosen from the group consisting of the oxides of aluminum, magnesium, chromium, manganese, iron, cobalt, copper, nickel, cerium and of the remaining transition series elements which form a gelatinous hydrated metal oxide when the salts thereof are reacted with a base;

dehydrating the hydrated metal oxide in the presence of said particulate metal oxide oxidant: and adding a metal azide chosen from the alkali and alkaline earth azides.

11. The method of claim 10 wherein said metal salt is chosen from the group consisting of the nitrates, chlorides, chlorates and perchlorates of said metals.

12. The method of claim 10 wherein said metal oxide oxidant is mixed with said metal salt prior to reaction with said base.

13. The method of claim 10 wherein the metal oxide oxidant is ferric oxide and the metal salt is ferric nitrate.

14. The method of claim 13 wherein the resultant composition includes between 0.01 and 0.16 moles of nitrate per mole of azide.

15. The method of claim 10 wherein the metal salt is a nitrate and wherein the resultant composition includes between 0.01 and 0.16 moles of nitrate per mole of azide.

16. The method of claim 13 wherein substantially all of the anion of the metal salt is retained in the composition during dehydration of the hydrated metal oxide.

17. The method of claim 10 wherein said base comprises an alkali metal silicate.

18. The method of claim 15 wherein substantially all of the anion of the metal salt is retained in said mixture during dehydration.

* * * * *